US005351628A

United States Patent [19]

Breezer et al.

[11] Patent Number: 5,351,628

[45] Date of Patent: Oct. 4, 1994

[54] WOOD AND PLASTIC PALLET

[75] Inventors: Harlon W. Breezer, Portage; Thomas M. Pintar, Coloma; Michael J. Wolfe, Pardeeville, all of Wis.

[73] Assignee: TriEnda Corporation, Portage, Wis.

[21] Appl. No.: 38,711

[22] Filed: Mar. 26, 1993

[51] Int. Cl.[5] ..... B65D 19/16

[52] U.S. Cl. ..... 108/56.1; 108/51.1

[58] Field of Search ..... 108/51.1, 56.1, 56.3, 108/52.1

[56] References Cited

U.S. PATENT DOCUMENTS

| | | | |
|---|---|---|---|
| 2,922,606 | 1/1960 | Glassman et al. | 248/120 |
| 2,930,560 | 3/1960 | Carnwath et al. | 248/120 |
| 3,207,096 | 9/1965 | Munroe | 108/51.1 |
| 3,277,847 | 10/1966 | Jensen | 108/51 |
| 3,835,791 | 9/1974 | Brown | 108/51 |
| 3,910,202 | 10/1975 | Skahan | 108/51 |
| 4,128,253 | 12/1978 | Powers | 280/79.1 |
| 4,267,781 | 5/1981 | Powers | 108/56.1 |
| 4,604,014 | 8/1986 | Frano | 411/338 |
| 4,735,154 | 4/1988 | Hemery | 108/56.1 |
| 4,738,204 | 4/1988 | Hammarberg | 108/51.1 |
| 4,742,781 | 5/1988 | Shuert | 108/53.3 |
| 4,790,249 | 12/1988 | Webb | 108/51.3 |
| 4,955,940 | 9/1990 | Welleman | 108/56.1 |
| 5,052,307 | 10/1991 | Morrison | 108/53.1 |
| 5,094,175 | 3/1992 | Christie | 108/56.1 |

FOREIGN PATENT DOCUMENTS

| | | | |
|---|---|---|---|
| 2057804 | 12/1979 | Fed. Rep. of Germany | 108/51.1 |
| 0709051 | 5/1954 | United Kingdom | 108/51.1 |

*Primary Examiner*—Peter R. Brown
*Assistant Examiner*—Gerald A. Anderson
*Attorney, Agent, or Firm*—Lathrop & Clark

[57] ABSTRACT

A wooden upper deck is connected by two types of plastic spacer blocks to a wooden lower deck. The upper deck may be a conventional deck composed of stringers and slats or it may be a twin sheet thermoformed plastic deck. The lower deck is composed of stringers which underlie the plastic spacers and tie boards which abut the ends of the stringers. Connector spacer blocks serve both to join the upper deck to the lower deck and to connect the stringer boards to the tie boards. The stringers and tie boards are held in fixed relation by bolts which join the upper and lower decks passing through sockets in the spacer blocks. The stringers and the tie boards are bolted to the spacer blocks and are thus joined. The joint between the stringers and the tie boards may be strengthened by means of a metal link overlying the stringers and tie boards and linking the bolts together.

14 Claims, 4 Drawing Sheets

WOOD AND PLASTIC PALLET

FIELD OF THE INVENTION

The present invention relates to pallets in general and, in particular, to pallets which are partially constructed of wood and partially constructed of plastic.

BACKGROUND OF THE INVENTION

Pallets first came into wide-spread use during World War II where the efficiency of the movement and storage of goods was greatly increased through the use of pallets. Pallets allow the storage and movement of different items by a common material handling system employing forklift trucks. The first widely used pallets were constructed of wood, normally hardwood because of its low cost, ready availability and high compressive strength.

Although wood pallets are still widely used in the industry, in many situations plastic pallets have been found more cost effective or able to meet cleanliness needs, special packaging requirements or other standards not readily satisfied by wood pallets. In certain applications, however, plastic pallets may not be economically justifiable due to the higher cost of acquisition caused by the relatively higher price of the plastic from which they are fabricated.

Plastic parts are more easily formed to complicated shapes, are often more light-weight than wood, resist splintering and chipping, and do not absorb liquids. Wood parts tend to be cheaper, more readily available, and stronger.

What is needed is a pallet combining the unique advantages of both plastic and wood pallets.

SUMMARY OF THE INVENTION

The pallet of this invention has an upper deck and a lower deck which are spaced apart by plastic spacer blocks. The upper deck is composed of stringer boards which are overlaid by wide and narrow slats. The wide slab are positioned over the plastic spacer blocks. The lower deck is composed of shorter stringer boards which underlie the stringers in the upper deck, and abut tie boards which form the ends of the pallet. The bottom stringer boards and tie boards do not overlap and are not directly connected to each other. The bolts which attach the upper deck to the lower deck through the spacer blocks also connect the lower stringer boards to the tie boards. Each spacer block is a plastic unit formed by extrusion or injection molding. The block contains two bolt holes which guide the bolts as they pass from the upper deck to the lower deck and hold the bolts in fixed spaced relation. Because the bolts are attached to the bottom stringer boards and the tie boards and are held in fixed relation by the spacer blocks they hold the stringer boards and tie boards in fixed relation.

An aluminum link is provided which is inset into the bottom of the spacer blocks and which forms a reinforcing link of metal which overlies the bottom deck and reinforces the joinder of the bottom deck boards by means of the bolts. The link reinforces the deck by being clamped by means of the bolts and the spacer blocks across the juncture of the stringer and tie boards and holding them in fixed relation. The link also provides shear strength along the abutment between the stringer boards and tie boards. The upper deck slats are nailed in a conventional fashion to the upper stringer boards. Alternatively the upper deck may be a twin sheet thermoformed plastic deck. When a plastic deck is employed, plastic t-bolts with large square, flat heads which interface with the plastic deck are employed. Yet another alternative upper deck is a sheet of plywood either mounted on the stringer boards or mounted directly on top of the plastic spacers.

It is an object of the present invention to provide a pallet intermediate in cost between that of plastic and wood pallets while having the advantages of both types of pallets.

It is another object of the present invention to provide a pallet which can be readily repaired when required with a minimum of time, effort and replacement materials.

It is also an object of the present invention to provide a pallet having spacers between the upper and lower deck which cannot be split when the deck, stringer or tie boards are fastened thereto.

It is an additional object of the present invention to provide a pallet having relatively wide openings for the entry of a forklift or the like.

It is a further object of the present invention to provide a pallet employing plastic spacers which also function to strengthen the lower deck.

It is yet another object of the present invention to provide a pallet with improved structure for support on pallet racks.

It is yet a further object of the present invention to provide a pallet with an impervious upper deck combined with a reinforced lower wooden deck.

Additional objects, features, and advantages of the present invention will become apparent from the following specification when read in conjunction with the accompanying drawings.

DESCRIPTION OF THE PREFERRED EMBODIMENT

Figure 1:
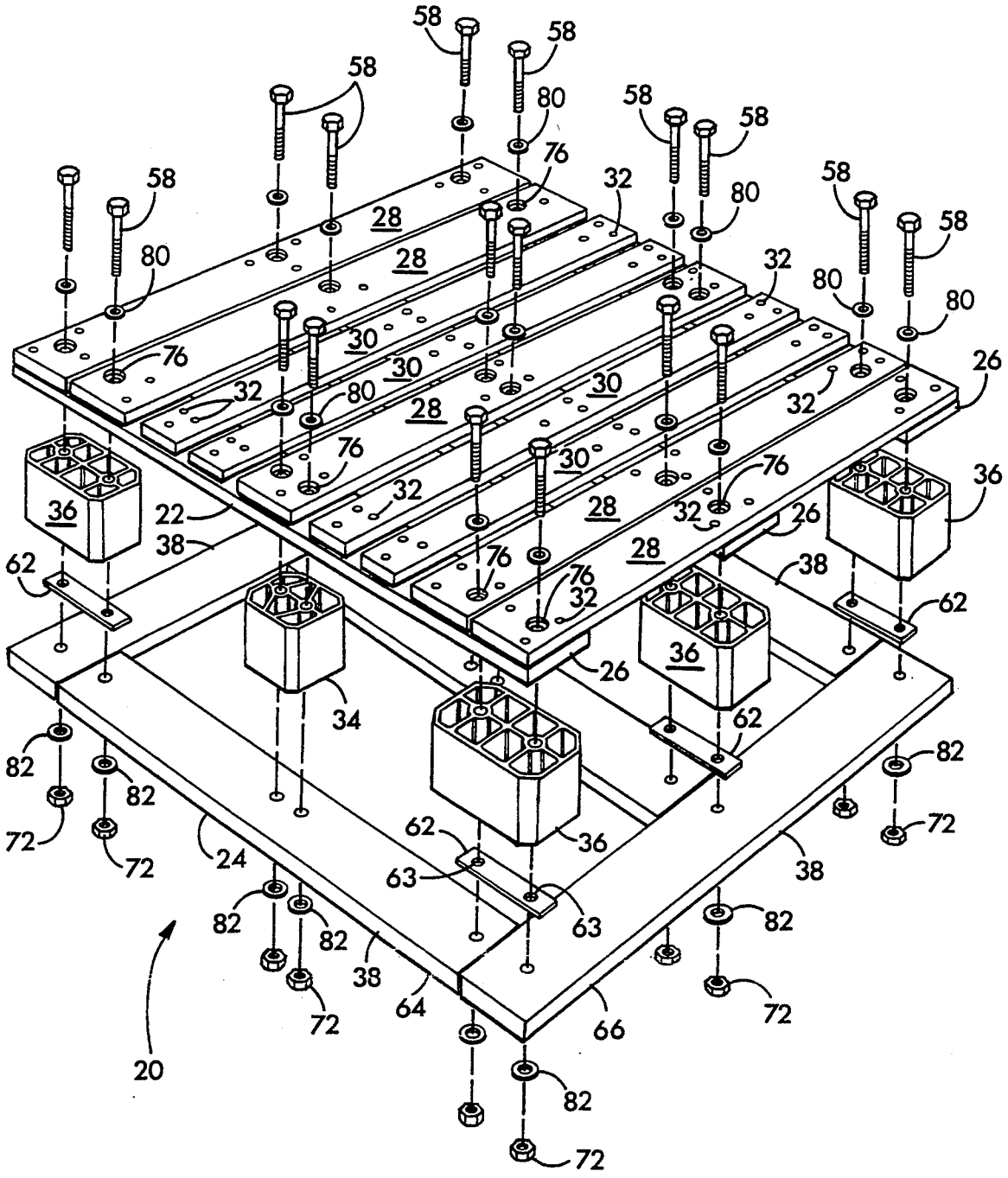
FIG. 1 is an exploded perspective view of the pallet of the present invention.
Figure 5:
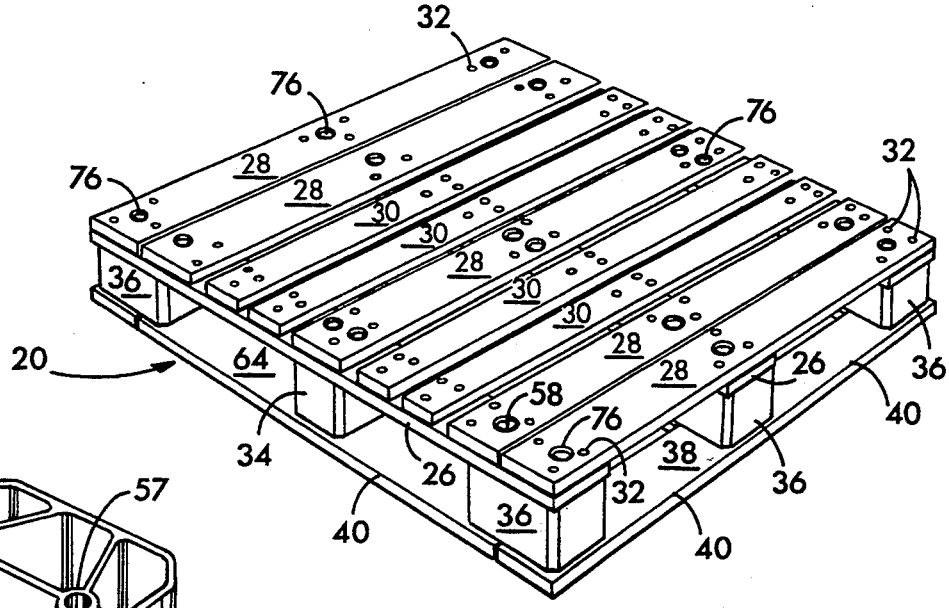
FIG. 5 is an isometric view of the pallet of FIG. 1.
Figure 4:
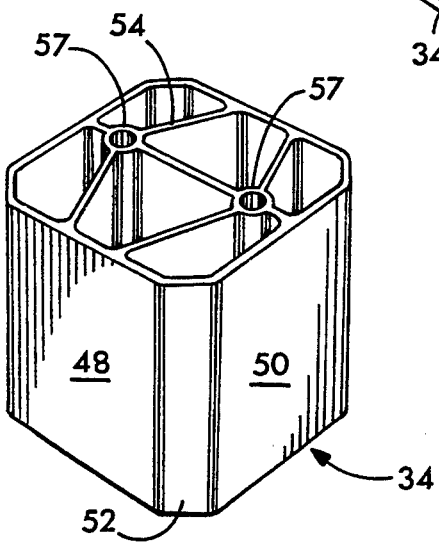
FIG. 4 is a top isometric view of a mid-span spacer block of the pallet of FIG. 1.

Referring more particularly to FIGS. 1–10 wherein like numbers refer to similar parts, a pallet 20 of the present invention is shown in FIGS. 1 and 5. The pallet 20 has an upper deck 22 and a lower deck 24. Both decks 22, 24 are formed of connected wooden boards. The upper deck 22 is composed of upper stringer boards 26 which are overlain by wide slats 28 and narrow slats 30. The slats 28, 30 are attached by nails 32 to the upper stringer boards 26. The boards 26, 28, 30 are thus joined by the nails 32 to form the connected and generally rigid upper deck 22. The lower deck 24 is composed of laterally extending stringers 64 and longitudinally extending tie boards 66 which are connected together by plastic spacer blocks 34, 36. The lower deck is in turn connected to the upper deck by the same plastic blocks 34, 36.

The construction of the upper deck 22 of stringers 26 and slats 28, 30 is conventional. The spacer blocks 34, 36 however, provide advantages over the conventional wood blocks which are often employed as spacers.

Figure 6:
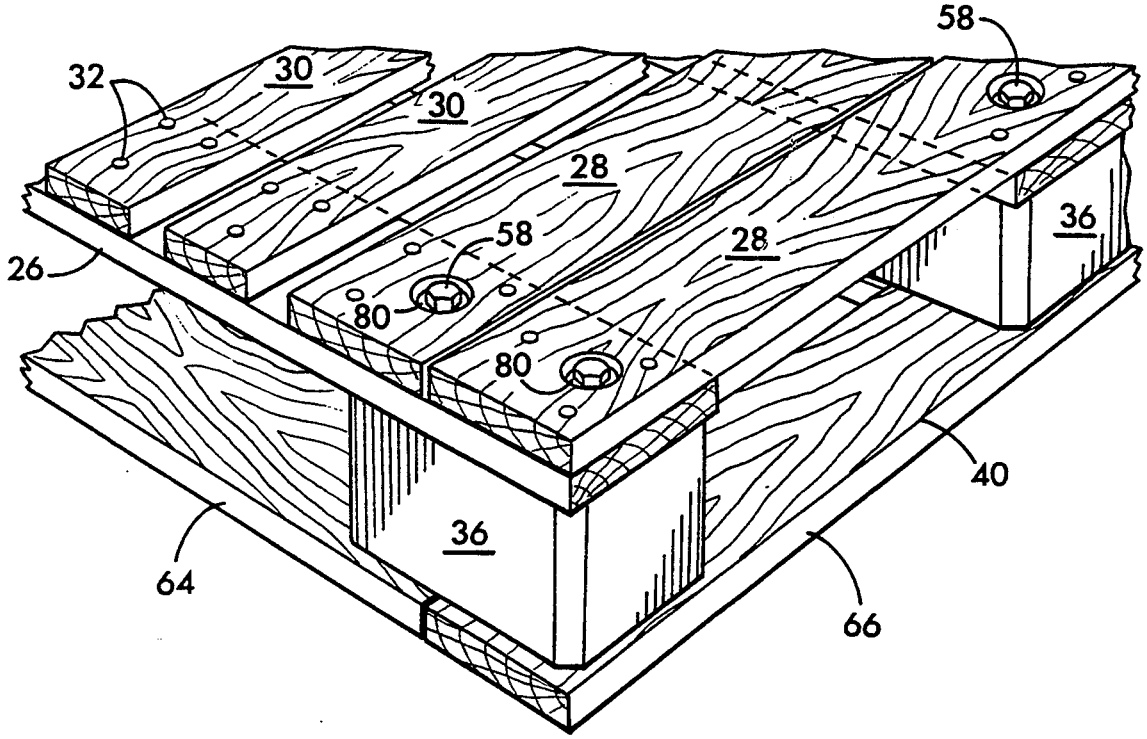
FIG. 6 is a fragmentary top isometric view of the pallet of FIG. 1.
Figure 7:
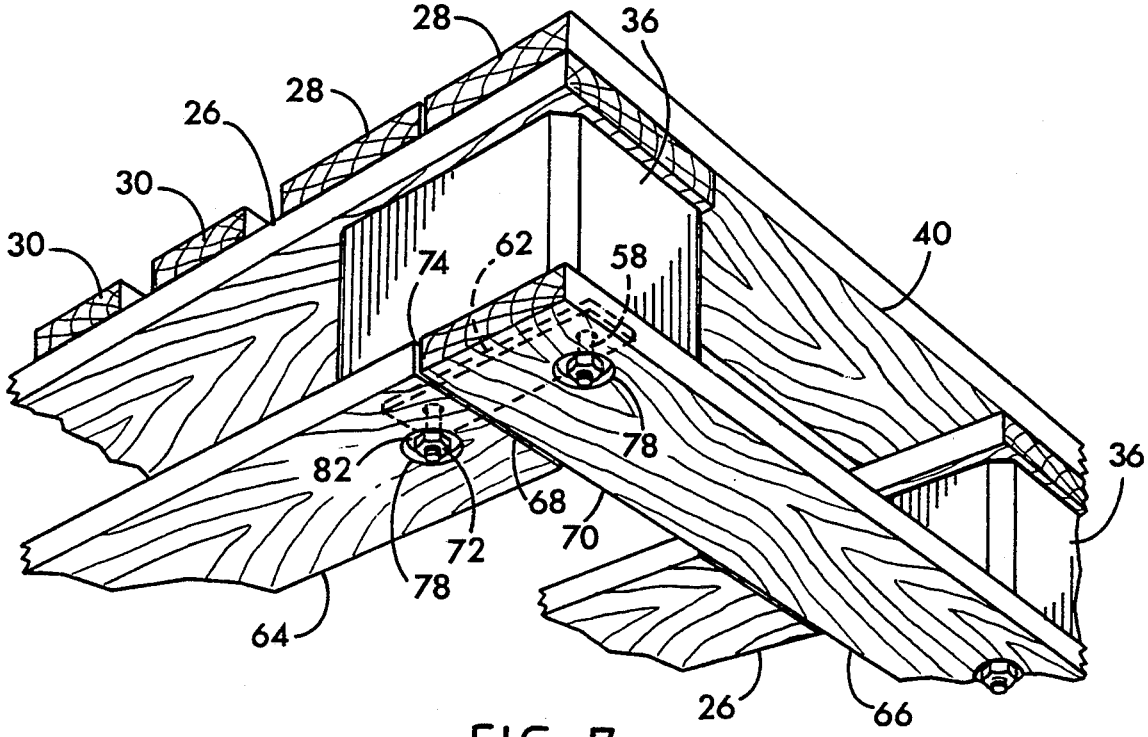
FIG. 7 is a fragmentary bottom isometric view of the pallet of FIG. 1 showing portions of the bolts and the mechanical reinforcing link connecting them in hidden lines.

The pallet 20, as shown in FIGS. 1 and 5, is of the four-way entry type, which allows the tines of a forklift to be inserted between the decks from any of the four pallet sides 38 through tine openings 40 best shown in FIGS. 5, 6 and 7.

In a conventional wood pallet a four-way entry is commonly provided by utilizing relatively short wooden segments as spacers. Such a use of small blocks to form a four-way entry pallet results in high compressive loads in the spacer blocks. As a conventional wood pallet may be expected to support a load of up to 100,000 pounds it can be seen that the tendency of short wooden pieces to split under compressive loads is exacerbated in a four-way entry pallet employing wood spacers. In the pallet 20 this problem is through the use of plastic spacer blocks 34, 36. The blocks are preferably formed of high density polyethylene and may be cost-effectively formed by extrusion. The blocks may also be injection molded.

The pallet 20 has nine spacer blocks of two types. Both types of blocks have two plastic sockets for receiving bolls therethrough. Although all blocks 34, 36 space and connect the upper and lower decks, the larger connector blocks 36 also connect the lower deck stringers 64 and tie boards 66 together. Connector spacer blocks 36 are located at the corners of the pallet 20 and at the ends of the pallet where lower deck stringers 64 adjoin a tie board 66. Mid-span blocks 34 are located on the lower deck stringers 64 intermediate between the tie boards 66 and are employed where no connecting function is required.

Figure 2:
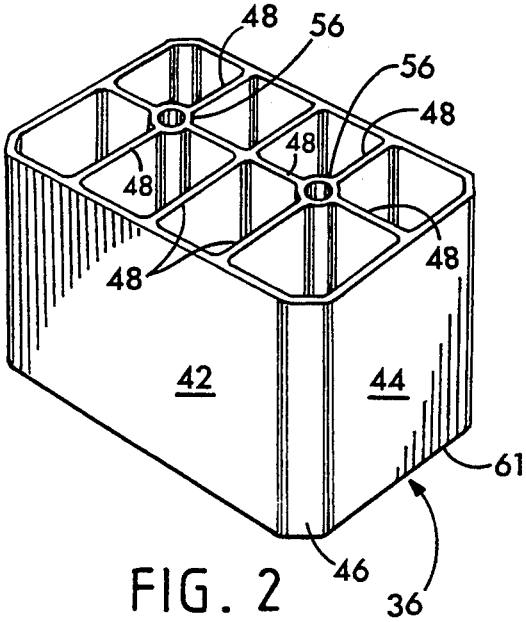
FIG. 2 is a top isometric view of a plastic connector spacer block employed in the pallet of FIG. 1.
Figure 3:
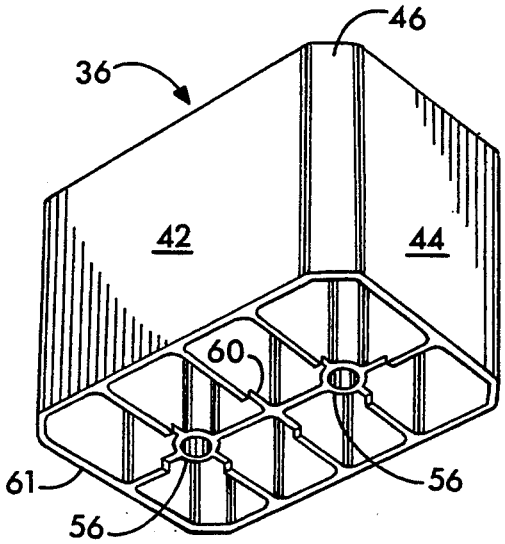
FIG. 3 is a bottom isometric view of the plastic block of FIG. 2.

In a preferred embodiment, the connector spacer blocks 36, best shown in FIGS. 2 and 3, are approximately 8 inches long, $5\frac{1}{4}$ inches wide and 3 inches high. The mid-span blocks 34 are 5 inches long by $5\frac{1}{4}$ inches wide and 3 inches high. The spacer blocks 34, 36 are generally rectangular with side walls which meet at bevelled corner walls. The blocks are reinforced internally by integral plastic webs 48. The side walls 42, 44 as well as the bevelled corner walls 46 and the internal webs 48 of the connector blocks 36 have a thickness of approximately 3/16 inches. Similarly the side walls 49, 50, corner walls 52 and internal webs 54 of the smaller mid-span blocks 34 are approximately 3/16 inches thick. The plastic spacers 34, 36 are of a design to readily resist high compressive loads. Further by forming the spacer side walls and webs to a desired greater or lesser thickness, the optimum strength for a particular application may be obtained at minimum spacer weight and cost.

Because plastic in general and polyethylene in particular is a ductile material which deforms elastically and plastically under load it has the ability to distribute loads through out the spacer, thus preventing local regions of the spacer from becoming over-stressed. Frequently in wooden spacers such local overloads result in splitting or cracking of the wooden spacers. Yet another advantage of the plastic spacers over wood spacers is their lighter weight which results in reduced shipping costs both when the pallets 20 are loaded and when they are transported unloaded.

The connector blocks 36 have two bolt retention sockets 56 each of which is formed at the juncture of four webbed segments 48. The mid-span spacer blocks 34 also have two bolt retention sockets 57. The bolts 58 extend through the bolt sockets 56, 57 joining the upper deck 22 with the lower deck 24 and clamping the spacers 34, 36 therebetween. The bolt sockets 56, 57 retain and position the bolts 58 with respect to the blocks 34, 36.

Each connector block 36 has relieved portions 60 on the underside of the block at which the webs 48 and sockets 56 are recessed from the level of the block base 61. The relieved portions 60 allow the flush nesting of a reinforcing metal link 62 against the webs 48 and sockets 56 such that the link does not protrude beneath the base 61. The metal link 62 may, for instance be formed out of quarter inch aluminum bar stock and serves to restrict the separation of the bottom deck stringers 64 and tie boards 66 which are connected by bolts 58 to the spacer blocks 36. As shown in FIG. 1, the links 62 each have two bolt holes 63 which coincide with the bolt sockets 56.

In some conventional wooden pallets stringer boards alone underlie the spacers between the upper and lower deck. Such prior art pallets, however, which fail to tie the bottom stringers together, are susceptible to having the bottom stringers sheared off if the pallet is skidded or if shear forces are otherwise applied to the spacers.

One approach to prevent shearing of the bottom stringers is to nail tie boards beneath the stringers. However, if only two tie boards are employed and they underlie the stringers the pallet loads are undesirably concentrated at the ends of the pallet along the tie boards. On the other hand a complete covering of the lower deck with slats in a way similar to the upper deck is wasteful of materials.

The pallet 20, as best shown in FIG. 1, has three wooden stringer boards 64 which extend between and are engaged against two tie boards 66. The stringers 64 of the pallet 20 are tied to the tie boards 66 by the plastic connector spacers 36 without requiring the tie boards 66 to underlie the swingers 64. Instead, the ends 68 of the stringers 64 abut the sides 70 of the tie boards 66. The structural connection between the stringers 64 and the tie boards 66 is accomplished by their mutual fastening to the connector blocks 36 by means of the bolts 58 and nuts 72. The joinder of the stringers 64 and the tie boards 66 is further reinforced by the links 62 which prevent lateral displacement between the ends 68 of the stringers 64 and the sides 70 of the tie boards 66. The links also support shear loads along the junctures 74 formed between the stringers 64 and the tie boards 66.

The importance of the strong structural joint between the stringer boards 64 and the tie boards 66 is particularly emphasized when the pallets are used in their loaded condition on pallet racks. A pallet rack usually consists of two horizontal supports which extend from a vertical rack. The pallet is placed with the bottom deck 24 resting on the horizontal supports. The horizontal supports will normally be somewhat narrow and underlie the position occupied by the tie boards. Thus the pallet must act as a beam supporting the distributed pallet load and transmitting it to the horizontal supports of the pallet rack. For the pallet to properly function as such a beam the stringer 64 must be tied to the tie board 66 so that loads may be transferred from the center of the pallet to the extremities where the support is provided.

A typical forty-eight by forty inch pallet 20 employs three mid-span spacer blocks 34 and six connector spacer blocks 36 for a total of nine spacer blocks. The mid-span spacer blocks 34 serve to tie the upper stringers 26 to the lower stringers 64. They also transmit the mid-span compressive load to the swingers 64 of the lower deck 24. Each spacer has two bolts 58 for a total of 18 bolts. The bolts are counter-sunk by means of spot faces 76 on the upper deck and spot faces 78 on the lower deck 24. Washers 80 are used to distribute the bolt loads where the bolts pass through the upper deck 22 slats 28. The lower nuts 72 are preferably of the type having large bearing surfaces and employing locking prongs (not shown) which grip the wood of the stringers 64 and tie boards 66 thus preventing their rotation and allowing the assembly of the pallet by applying a wrench to the bolts 58 from the upper deck 22. If locking nuts with prongs are not used then lower washers 82 should be employed to distribute the bolt loads.

Nails 32 join the upper deck slab 28, 30 to the upper deck stringers 36. The spot faces 76, 78 prevent the bolts 58 or nuts 72 from bearing on the pallet load or the support surface on which the pallet 20 rests.

Certain applications, such as those in the food industry, require pallets with an upper deck which is continuous, non-absorbent, conducive to repeated cleanings, and resistant to rust from exposure to moisture.

Figure 8:
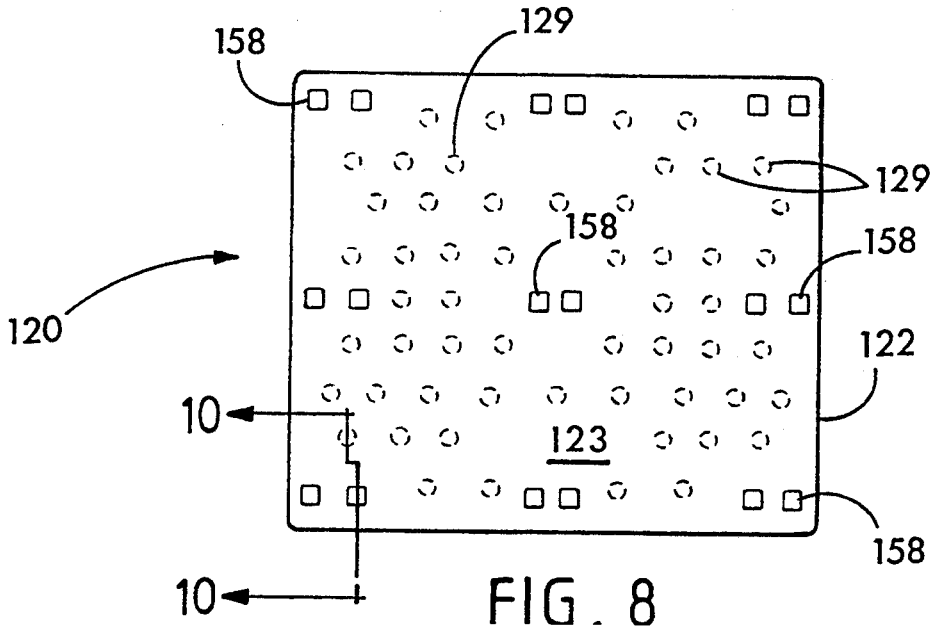
FIG. 8 is a top plan view of an alternative embodiment of the pallet of the present invention.
Figure 9:
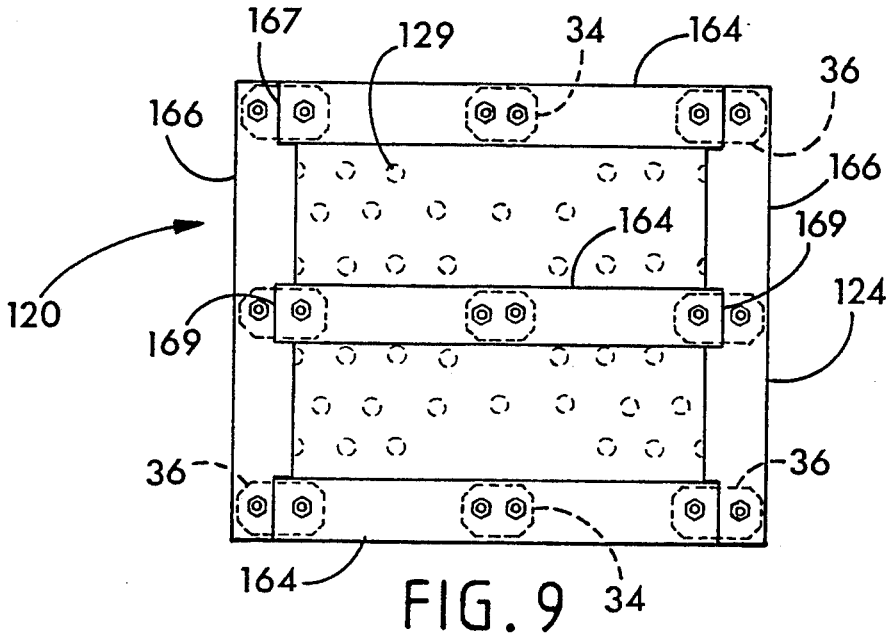
FIG. 9 is a bottom plan view of the pallet of FIG. 8.
Figure 10:
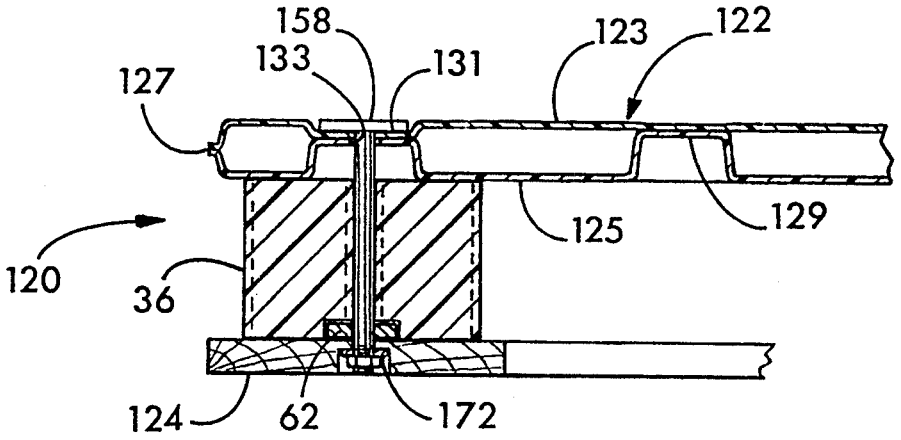
FIG. 10 is an enlarged partial cross-sectional view of the pallet of FIG. 8 taken along section line 10—10.

The alternative embodiment pallet 120 provides a substantially continuous, moisture resistant deck and is shown in FIGS. 8, 9 and 10. The top deck 122 of the pallet 120 is formed of twin sheet thermoformed thermoplastic sheets. As shown in FIG. 10, the upper deck 122 is composed of a generally planar upper sheet 123 and a lower sheet 125 which are joined at their edges by a peripheral lip 127 and are held in parallel spaced relation by circular protrusions 129 which extend from the lower sheet and abut and are fused to the upper sheet 123. Also formed in the twin sheet upper deck 122 are bolt flats 131 and bolt holes 133. Square headed plastic t-bolts 158 join the upper deck 122 with the lower deck 124 and clamp plastic connector blocks 36 and mid-span spacer blocks 34 therebetween. The bottom deck 124 has stringers 164 and tie boards 166. The tie boards 166 have cutouts 167, 169 into which the stringer boards 164 are inset. The cutouts 167, 169 allow for the use of wider tie boards thus providing a greater platform area on the lower deck 124 of the pallet 120. The cutouts 167, 169 also keep the pallet 120 square by preventing angular displacement between the stringers 164 and tie boards 166.

The T-bolts 158 are preferably plastic with metal nuts 172 which have plastic inserts (not shown) which resiliently grip the threads of the t-bolts 158 to lock the nuts against coming unscrewed.

The link 62 may be used with the spacers 36 in the pallet 120 with a plastic upper deck 122. The link 62 serves the same function of strengthening the lower deck 124 as it serves in the wood upper deck pallet 20.

It should be understood that the plastic spacers 36, serve to link the boles 58, 158 and, even in the absence of the links 62, will tie the stringers 64, 164 to the tie boards 66, 166.

It should also be understood that although an upper deck composed of stringers and slats is shown and described the slats could be replaced by a deck of plywood or the stringers and the slats could be replaced by a deck of plywood of suitable thickness.

It should also be understood that although protrusions 129 are shown holding the upper sheet 123 and lower sheet 125 in fixed parallel relation, other types of protrusions or channels extending from one or both sheets could be alternatively employed. Furthermore, the upper deck could be composed of a structural foam member or plastic deck formed by injection molding, blow molding, reaction injection molding or fiberglass.

While the pallets shown and described are of standard dimensions of 40 by 48 inches with a three inch gap between the upper and lower decks, it should be understood that pallets of different dimensions may also be formed employing the principles of the invention disclosed herein.

It should also be understood that although an aluminum link has been illustrated, the link could be composed of other metals or fiber reinforced plastics.

It should be understood that the bottom deck 124 could be employed with the pallet 20 of FIG. 1 and that the bottom deck 24 could be employed with the alternative embodiment pallet 120 of FIG. 9.

It is understood that the invention is not confined to the particular construction and arrangement of parts herein illustrated and described, but embraces such modified forms thereof as come within the scope of the following claims.

We claim:

1. A pallet comprising:

a) an upper load supporting deck;

b) a lower deck comprised of a plurality of laterally extending members and a plurality of longitudinally extending members;

c) a plurality of plastic blocks positioned between the upper deck and the lower deck, and engaged with the upper deck and the lower deck to space the upper deck a desired distance from the lower deck, wherein at least one of said plurality of blocks has portions defining at least two vertically extending sockets, wherein said at least one block is positioned above a joint formed between a laterally extending member and a longitudinally extending member of the lower deck; and d) a plurality of vertically extending fasteners which extend through the block sockets and are engaged with the upper deck and the lower deck members to join the lower deck laterally extending members to the lower deck longitudinally extending members and to join the lower deck to the upper deck.

2. The pallet of claim 1 wherein each block has a plurality of exterior walls and a plurality of reinforcing webs extend between the exterior walls and the sockets.

3. The pallet of claim 1 wherein at least one block has a base which engages against the lower deck, and portions of said block define a recess which is spaced above the lower deck, and further comprising a link disposed within the block recess, the link crossing the joint between a laterally extending and a longitudinally extending member of the lower deck, wherein a plurality of bolts extend through the link to restrict the separation of the lower deck members.

4. A pallet comprising:

a) a twin sheet thermoformed upper deck, having a first thermoplastic sheet fused to a second thermoplastic sheet at a plurality of pinch points;

b) a wooden lower deck comprised of laterally extending stringer boards and longitudinally extending tie boards which abut one another at a plurality of joints;

c) a plurality of plastic connector blocks engaged between the upper deck and the lower deck, wherein a connector block extends across each joint;

d) fasteners which extend through the upper deck, the connector blocks, and the lower deck boards, wherein at least two fasteners extend through each connector block, such that a fastener extends through each board adjacent a lower deck joint to fasten the stringer boards and the tie boards into a deck.

5. The pallet of claim 4 wherein the tie boards have portions defining at least one cutout into which at least one stringer board is inset.

6. The pallet of claim 4 further comprising at least one mid-span plastic spacer block extending between the upper deck and the lower deck and positioned to overlie a stringer board, wherein a plurality of fasteners extend through the upper deck, the spacer block and the lower deck stringer board.

7. A pallet comprising:

a) an upper wooden deck;

b) a lower wooden deck;

c) a plurality of plastic spacer blocks positioned between the upper deck and the lower deck, and engaged with the upper deck and the lower deck to space the upper deck a desired distance from the lower deck, wherein at least one of said plurality of blocks has portions defining at least two vertically extending sockets; and d) a plurality of bolts which pass through the sockets to join the plastic spacer blocks to the upper and lower decks, wherein the upper deck is comprised of wooden stringers which overlie the sockets in the plastic spacer and wooden slats running approximately perpendicular to the stringers, wherein at least one slat overlies sockets in the plastic spacer blocks, the upper deck slats and stringers having portions defining holes which correspond to the sockets in the spacer blocks, the bolts passing through the holes in the slats and stringers and the sockets in the spacer blocks thereby joining the upper deck to the spacer blocks, and wherein the bottom deck is comprised of bottom stringers and tie boards and wherein the bottom stringers and the tie boards underlie portions of the spacer blocks, the bottom stringers and tie boards having portions defining bolt holes, said portions being aligned with sockets in the plastic spacer blocks, and wherein the bottom stringers and the tie boards are joined to the plastic spacer blocks by the bolts passing through the bolt holes such that the bottom stringer bolt holes do not overlap the bottom tie board bolt holes.

8. The pallet of claim 7 wherein the tie boards have portions defining at least one cutout into which at least one stringer board is inset.

9. The pallet of claim 7 further comprising a means for reinforcing the connection of the stringer boards and tie boards.

10. A pallet comprising:

a) an upper load-supporting deck;

b) a lower wooden deck having bottom non-overlapping stringer boards and tie boards which abut one another;

c) a plurality of plastic blocks positioned between the upper deck and the lower deck, and engaged with the upper deck and the lower deck to space the upper deck a desired distance from the lower deck, wherein a plurality of blocks have portions defining at least two vertically extending sockets, wherein a block is positioned above a joint formed between a lower deck stringer board and tie board; and d) a plurality of fasteners which extend through the block sockets and join the upper deck with the lower deck and position the plastic spacers therebetween, wherein the fasteners mechanically connect the lower deck stringer boards and tie boards to form the lower deck, the fasteners joining the stringer boards and tie boards to the plastic blocks and thus joining the boards to each other.

11. The pallet of claim 10, further comprising a means for reinforcing the connection of the stringer boards and tie boards.

12. The pallet of claim 10, wherein the fasteners which join the upper and lower decks and connect the bottom stringer boards and tie boards are joined by a link which overlies the stringers and tie boards and reinforces the plastic spacer in joining the stringer boards and tie boards.

13. The pallet of claim 10, wherein the plastic spacers are of a substantially constant cross section, thereby facilitating their cost-effective manufacture by extrusion or injection molding.

14. A pallet comprising:

a) an upper load-supporting deck;

b) a lower wooden deck having bottom stringer boards and tie boards;

c) a plurality of plastic spacer blocks joining the upper deck and the lower deck in spaced relation, wherein the plastic spacer blocks have portions forming two or more bolt holes in a substantially vertical web; and d) a plurality of fasteners which join the upper deck with the lower deck and position the plastic spacers therebetween, wherein the fasteners mechanically connect the lower deck stringer boards and tie boards to form the lower deck, the fasteners joining the stringer boards and tie boards to the plastic spacers and thus joining the boards to each other, and wherein the fasteners are bolts which join the upper and lower decks and pass through the bolt holes and are thus held in fixed relation by the joining web, mechanically locking the lower deck stringers and tie members in fixed relation.

* * * * *